US005324577A

United States Patent [19]

Dalbec et al.

[11] Patent Number: 5,324,577

[45] Date of Patent: Jun. 28, 1994

[54] CONVERTIBLE FABRIC

[76] Inventors: Charles E. Dalbec, 88 Woodwind Dr., Spartanburg, S.C. 29302; Marshall S. Hobson, 1203 Hobby La., Anderson, S.C. 29621

[21] Appl. No.: 940,152

[22] Filed: Sep. 3, 1992

Related U.S. Application Data

[63] Continuation of Ser. No. 667,012, Mar. 11, 1991, Pat. No. 5,147,713.

[51] Int. Cl.[5] ..... B32B 27/02; B32B 27/08; B32B 27/20

[52] U.S. Cl. ..... 428/229; 428/264

[58] Field of Search ..... 428/229, 264; 139/420 R, 420 B, 426 R; 150/166; 160/DIG. 7; 296/107, 136

[56] References Cited

U.S. PATENT DOCUMENTS 5,147,713 9/1992 Dalbec ..... 428/229

*Primary Examiner*—James C. Cannon

[57] ABSTRACT

A single ply convertible top fabric comprising a sateen woven fabric using a blend of solution dyed polyester and cotton yarn coated with a PVC vinyl.

2 Claims, 1 Drawing Sheet

CONVERTIBLE FABRIC

This is a continuation of application Ser. No. 667,012 filed Mar. 11, 1991 for CONVERTIBLE FABRIC, now U.S. Pat. No. 5,147,713.

This invention relates to a single ply woven fabric for use, in particular, in the manufacture of tops for convertible automobiles.

Prior to this invention convertible tops were manufactured from 100% cotton woven fabrics which were dyed after they were woven. These tops tended to age and tear after a period of time causing necessary premature replacement of the top. The prior art tops also tended to discolor and stain as they age resulting in a displeasing appearance to the car on which it was installed.

Therefore, it is an object of the invention to provide a stronger substrate for convertible tops which, when dyed, do not allow the dye to migrate or bleed through the vinyl coating.

Figure 1:
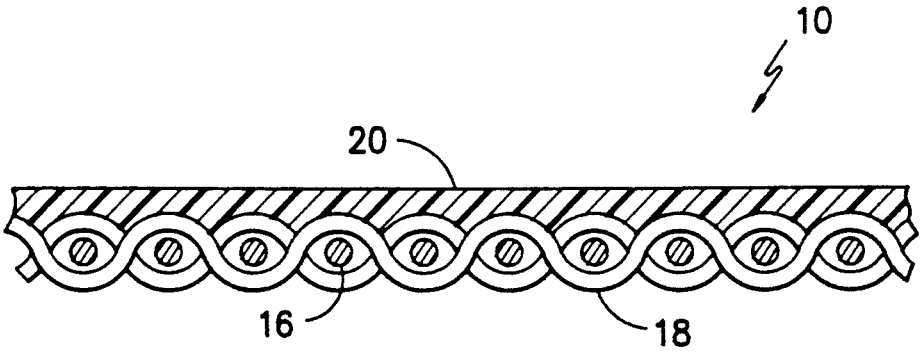
Figure 2:
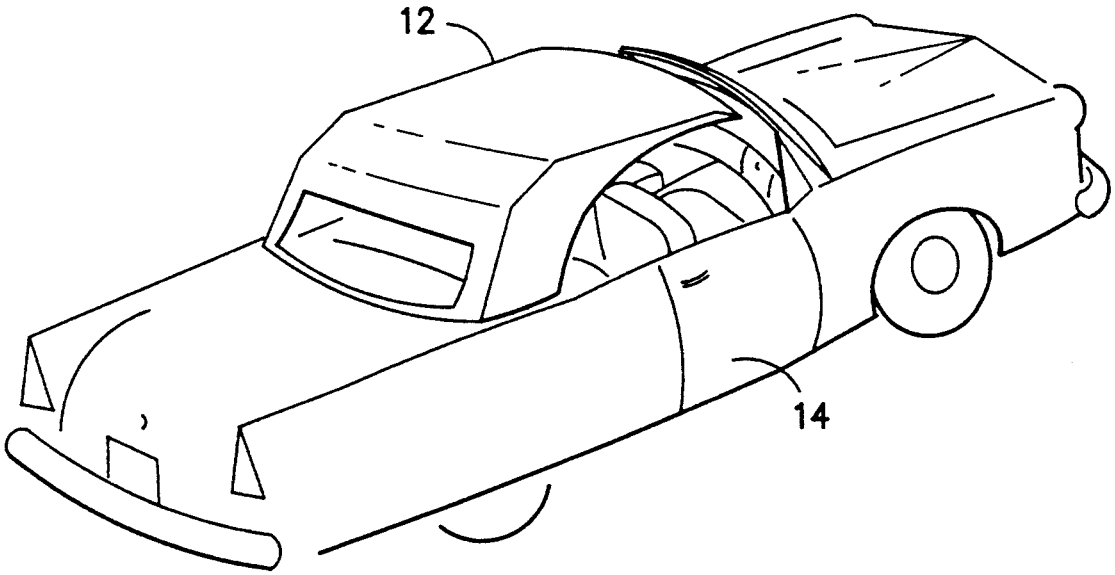

Other objects and advantages of the invention will become readily apparent as the specification proceeds to describe the invention with reference to the accompanying drawings, in which:

FIG. 1 is a cross-section view of the single ply fabric used in the automobile convertible top shown in FIG. 2.

Looking now to the drawings the reference number 10 represents a single ply coated woven fabric for use in a convertible top 12 for an automobile or truck 14. The woven fabric 10 consists basically of warp yarns 16 and weft yarns 18 woven into a substrate which is coated with a vinyl 20, such as PVC, to provide a single ply coated fabric 10 for use in making the convertible top 12.

In order to increase the strength of the substrate and consequently the strength of the convertible top, polyester yarn is employed. Since polyester yarn does not absorb dyestuffs readily it is necessary to use solution dyed polyester yarn. The term solution dyed yarn refers to yarn produced from an extruder or spinneret in which the dyes have been mixed with the molten yarn material prior to production of the yarn.

In the preferred form of the invention the warp and weft yarns are a 332 denier 65/35 blend of solution dyed carbon black polyester and cotton woven in a sateen weave. The finished fabric construction is 65" wide with 82 ends per inch and 42 picks per inch. The finished fabric has been dyed black so that the cotton therein shall be the same color as the solution dyed polyester yarn. Once the fabric has been coated with vinyl the dye in the solution dyed polyester yarn does not bleed or migrate through the vinyl coating to cause a discoloration thereof.

As noted above a 65/35 blend of polyester/cotton is preferred but other blends such as 50/50 can be used so long as the polyester in the blend is solution dyed.

The herein-described substrate fabric uses a blend of solution dyed polyester yarn and cotton which substantially reduces contamination during warping, slashing and weaving but which allows more efficient weaving. Furthermore, as compared to conventional cotton convertible top substrate fabrics it has increased tensile and torque wear strength and the dye in the polyester fibers does not bleed or migrate through the vinyl coating of the convertible top fabric.

Although the preferred embodiment of the invention has been described it is contemplated that many changes may be made within the scope of the invention and it is desired that the invention be limited only by the claims.

I claim:

1. A single ply fabric comprising: a plurality of polyester/cotton yarns interconnected together to form a fabric and a vinyl coating on said fabric, said polyester being solution dyed to prevent migration of dye through the vinyl coating.

2. The fabric of claim 1 wherein the polyester cotton blend is 65/35.

* * * * *